US007123861B2

(12) United States Patent
Eun

(10) Patent No.: US 7,123,861 B2
(45) Date of Patent: Oct. 17, 2006

(54) CONTACTABLE CHARGING TYPE CHARGING DEVICE FOR IMAGE FORMATION APPARATUS, AND METHOD OF MANUFACTURING THE SAME

(75) Inventor: Jong-moon Eun, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/299,763

(22) Filed: Nov. 20, 2002

(65) Prior Publication Data

US 2003/0099486 A1 May 29, 2003

(30) Foreign Application Priority Data

Nov. 29, 2001 (KR) ..... 2001-75060

(51) Int. Cl.
*G03G 15/02* (2006.01)

(52) U.S. Cl. ..... 399/174; 399/168

(58) Field of Classification Search ..... 399/168, 399/174, 176; 361/214, 220, 221, 225

See application file for complete search history.

(56) References Cited

U.S. PATENT DOCUMENTS 5,453,819 A * 9/1995 Shimura et al. ..... 399/174
5,535,088 A * 7/1996 Sato et al. ..... 399/168
5,557,374 A * 9/1996 Chen ..... 399/174
5,839,029 A * 11/1998 Kataoka et al. ..... 399/174
5,870,657 A * 2/1999 Nagame et al. ..... 399/174

* cited by examiner

*Primary Examiner*—David M. Gray
*Assistant Examiner*—Ryan Gleitz
(74) *Attorney, Agent, or Firm*—Staas & Halsey LLP

(57) ABSTRACT

A charging device charging a photosensitive medium of an image formation apparatus while being in contact with the photosensitive medium, supports both ends of a charging member having a plate-shaped elastic member by a support member, so that the charging member has a semicircular section. A curved surface of the charging member contacts a surface of the photosensitive medium to maintain a predetermined contact nip and a contact linear pressure. The charging device controls a total resistance by adjusting a material, a thickness, a contact area, and a radius of the charging member, and maintains the contact linear pressure and the contact nip from the photosensitive medium. As a result, the charging device can easily adjust an electric resistance, minimizing variations of the contact linear pressure and the contact nip, material and processing expenses can be cut down, and productivity of the charging device is improved.

20 Claims, 6 Drawing Sheets

CONTACTABLE CHARGING TYPE CHARGING DEVICE FOR IMAGE FORMATION APPARATUS, AND METHOD OF MANUFACTURING THE SAME

CROSS-REFERENCE TO RELATED APPLICATIONS

This application claims the benefit of Korean Patent Application No. 2001-75060, filed Nov. 29, 2001, in the Korean Intellectual Property office, the disclosure of which is incorporated herein by reference.

BACKGROUND OF THE INVENTION

1. Field of the Invention

The present invention relates to a charging device for an image formation apparatus such as a duplicator, printer and facsimile telegraph, and more particularly, to a charging device having a simple structure which can uniformly charge a photosensitive medium, and a method of manufacturing the same.

2. Description of the Related Art

In general, a charging device for a photosensitive medium receives a predetermined current and generates a surface potential on the photosensitive medium using a current according to a corona method, a contactable roller method or a contactable board method.

In the corona method, a corona discharger is used as a charging unit uniformly charging a surface of the photosensitive medium. The corona discharger efficiently uniformly charges the surface of the photosensitive medium to a predetermined potential. However, the corona discharger requires a high voltage power, and generates ozone during a discharging operation. The ozone contaminates an environment, and the photosensitive medium drum and a charging member deteriorate.

In order to solve the foregoing problem, the contactable roller method employs a charging roller instead of the corona discharger. Referring to FIG. 1, a contactable roller type charging device includes a charging roller 20 driven in contact with the photosensitive medium 30. The charging roller 20 has a shaft 21. When a power supply unit 10 supplies a voltage to the shaft 21 of the charging roller 20, the charging roller 20 charges a surface of a dielectric substance. In the contactable roller method, the charging roller 20 is disposed to contact the photosensitive medium 30 to generate the surface potential on the photosensitive medium 30. That is, when the voltage of about −1 to −2 kV is applied to the shaft 21 of the charging roller 20, the charging roller 20 having a resistance of about '$1\times10^4\Omega\sim9\times10^7\Omega$' generates an electric discharge on a contact portion of the photosensitive medium 30 and the charging roller 20. The voltage is transmitted from the power supply unit 10.

When the photosensitive medium 30 receives the predetermined current, the surface potential is generated thereon according to a property of a surface dielectric layer of the photosensitive medium 30. The surface potential generated on the photosensitive medium 30 is in proportion to the voltage applied to the charging roller 20. When the shaft 21 of the charging roller 20 receives a direct current power, the surface potential of the photosensitive medium 30 is generated from an electric discharge start voltage, and increased in proportion to the voltage to a predetermined voltage level.

In the contactable board method, as illustrated in FIGS. 2 and 3, a conductive elastic member 40 is installed to contact the photosensitive medium 30 to generate the surface potential on the photosensitive medium 30. In order to maintain a predetermined contact nip, the conductive elastic member 40 is positioned to contact the photosensitive medium 30 with a predetermined contact linear pressure. In addition, the conductive elastic member 40 has a transformation (deflection) amount of '$\delta$' with the photosensitive medium 30 due to the contact linear pressure. When the power supply unit 10 transmits power to a high voltage unit terminal 11, the conductive elastic member 40 having a resistance of about '$1\times10^4\Omega\sim9\times10^7\Omega$' generates an electric discharge on the contact portion of the photosensitive medium 30 and the conductive elastic member 40 according to a resistance property.

When the predetermined current is transmitted to the photosensitive medium 30 due to the electric discharge, the surface potential is generated according to the property of the surface dielectric layer of the photosensitive medium 30. The surface potential generated on the photosensitive medium 30 is in proportion to the voltage applied to the conductive elastic member 40. A length and thickness of the conductive elastic member 40 are set up by a relational expression of Cantilever load and deflection, so that the conductive elastic member 40 and the photosensitive medium 30 can maintain the contact linear pressure constant.

The contactable roller method has been widely used to solve the problems of the corona method having a low energy efficiency, an ozone generation, and an irregular charging. That is, the contactable roller method lowers the voltage for charging the photosensitive medium and limits and reduces the ozone generation during the charging operation. Moreover, the contactable roller method prevents dust particles from being electrostatically deposited on a corona wire, and does not require the high voltage power.

However, the contactable roller method has disadvantages in that charging distribution is not uniform and a charging potential is very sensitive to the environment. As compared with the corona method using the corona discharger, the contactable roller method is not preferable in uniformity of the charging distribution. When the charging roller is left at a low temperature, an electric resistance of the charging roller is increased to reduce the charging potential of the photosensitive medium more than at a normal temperature and humidity by about 200V. Therefore, a reverse phenomenon causing ink blots on print matters may be generated.

In addition, the contactable roller method must perform complicated processes, such as extrusion and polishing process, in manufacturing the charging roller and uses special conductive materials to increase raw material expenses and process expenses. When the charging roller is maintained at a high temperature for an extended period of time, a low molecular weight material of the charging roller is migrated to the contact portion of the charging roller and the photosensitive medium, and thus, a horizontal band phenomenon is generated near the contact portion of the photosensitive medium. In order to minimize the migration of the low molecular weight material, the charging roller must be formed of a special resin, or an outer layer of the charging roller must be coated or tubed, which results in high prime cost. In the polishing process, the surface of the charging roller may be caved, and spot defects may be generated due to a pinhole of the surface of the charging roller. Moreover, the polishing, processing and coating processes of the charging roller must be precisely performed to prevent foreign materials from being introduced into the charging roller. Accordingly, the prime cost is increased, and mass production is hardly achieved.

As compared with the contactable roller method, the contactable board method is highly advantageous in cost. However, the contactable board method has difficulty in maintaining elasticity for the contact linear pressure between the conductive elastic member and the photosensitive medium and it is impossible to keep the contact nip between the conductive elastic member and the photosensitive medium. It is therefore difficult to uniformly maintain the surface potential of the photosensitive medium. In addition, the contact nip is hardly maintained in contacting and charging the surface of the photosensitive medium, especially a board using a cantilever method. Accordingly, the contactable board method is not stabilized in motion and rotation and needs improvements of the contact nip.

SUMMARY OF THE INVENTION

Accordingly, it is an object of the present invention to provide a charging device which can prevent charging defects by using a conductive elastic member having a high mass conductivity.

Additional objects and advantageous of the invention will be set forth in part in the description which follows and, in part, will be obvious from the description, or may be learned by practice of the invention.

In order to achieve the above and other objects of the present invention, there is provided a contactable charging type charging device charging a photosensitive medium of an image formation apparatus. The charging device is in contact with the photosensitive medium and includes a charging member having both ends supported and elastically biased by a support member of a developing device of the image formation apparatus to form a curved surface contacting the photosensitive medium and a section having a predetermined radius, and a terminal transmitting a voltage to the charging member.

The charging member has a semi-elliptical section. An elastic coefficient, a thickness and a width of the charging member are set up according to Castigliano's theorem so that the photosensitive medium and the charging member can contact each other with a predetermined contact nip and a contact linear pressure. The photosensitive medium and the charging member are disposed to have a sufficient contact deformation amount to maintain the contact nip and the contact linear pressure. In addition, the photosensitive medium and the charging member have a contact resistance of $10^4\Omega$~$10^8\Omega$. The charging member is formed of a conductive polymer, metal or conductive rubber which has a volume resistivity of $10^3$~$10^8$ Ωcm. The charging member has a thickness below 3 mm and a curvature radius below 10 mm.

The charging member may include a plurality of layers. Here, resistances of the layers are formed so that a composite resistance of the layers ranges between $10^5$ and $10^8\Omega$. The layers of the charging member include an inner layer and an outer layer having an electric resistance greater than that of the inner layer, and thus the composite resistance is determined by the outer layer. The inner layer of the charging member has a volume resistivity below $9\times10^7$ Ωcm, and the outer layer thereof has a volume resistivity over $9\times10^6$ Ωcm. The inner layer of the charging member includes the metal or the conductive polymer, and the outer layer thereof includes the conductive rubber or the conductive polymer. Especially, since the contact linear pressure is easily adjustable differently from a general roller method, there are no other limitations in selecting a material of the charging member except for the electric resistance.

The voltage applied to the terminal is obtained by overlapping an AC voltage having a peak to peak voltage at least twice as high as a charging start voltage with a DC voltage. A foamed elastic auxiliary member can be installed inside the charging member. Here, the elastic auxiliary member has a larger section than the charging member to apply the contact linear pressure to the charging member.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
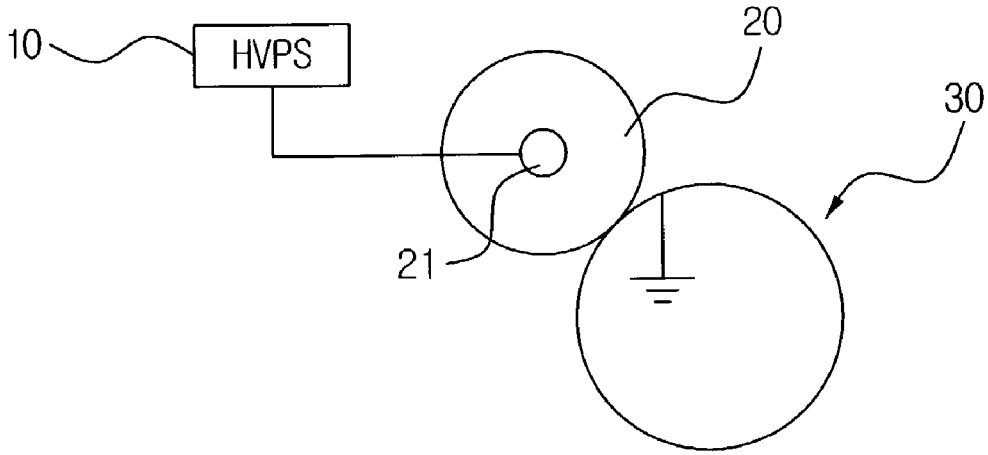
FIG. 1 (PRIOR ART)
FIG. 1 is a schematic diagram illustrating a conventional contactable roller type charging device.
Figure 2:
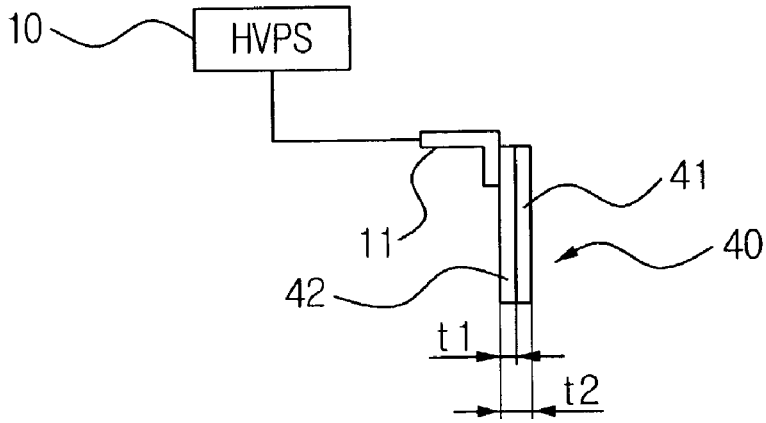
FIG. 2 (PRIOR ART)
FIGS. 2 and 3 are schematic diagrams illustrating a conventional contactable board type charging device.
Figure 3:
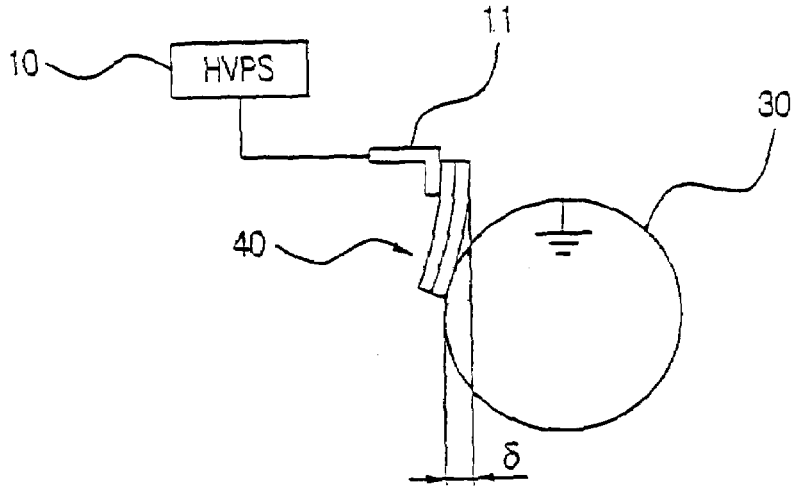
FIG.3 (PRIOR ART)

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

A charging device for an image formation apparatus and a method of manufacturing the same in accordance with a preferred embodiment of the present invention will now be described in detail with reference to the accompanying drawings.

Figure 4A:
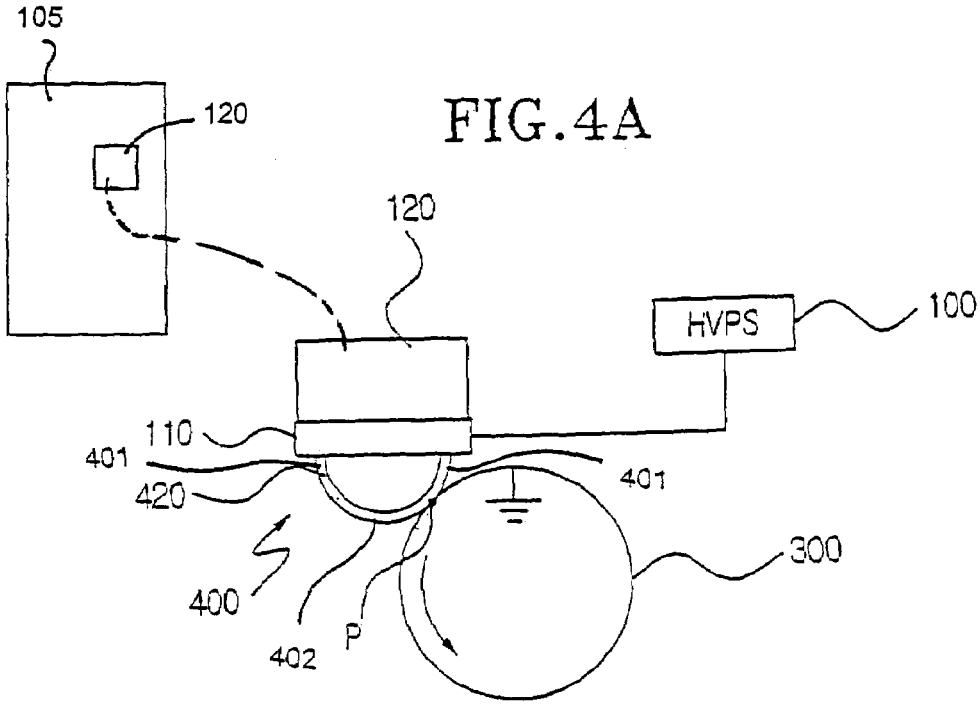
FIGS. 4A to 4D are schematic diagrams illustrating a charging device in accordance with embodiments of the present invention.
Figure 4B:
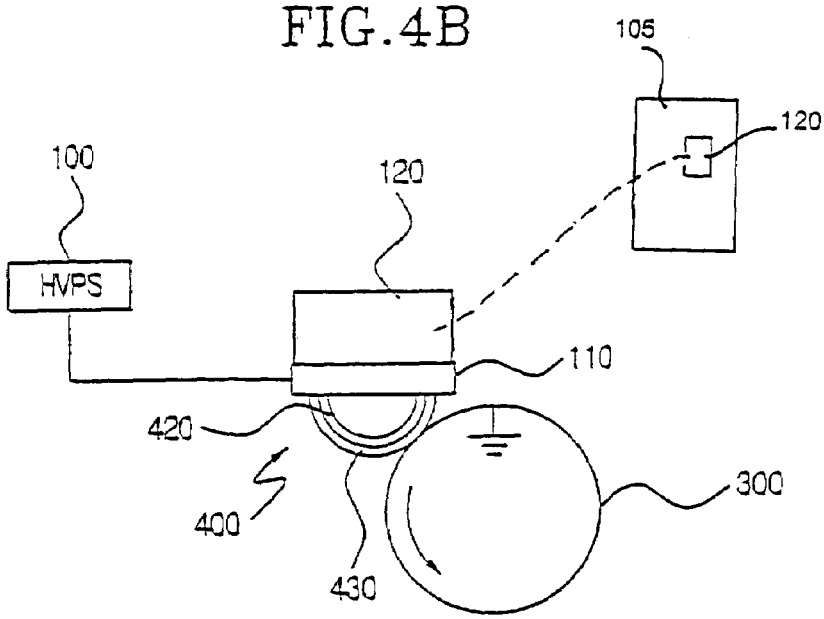
Figure 4C:
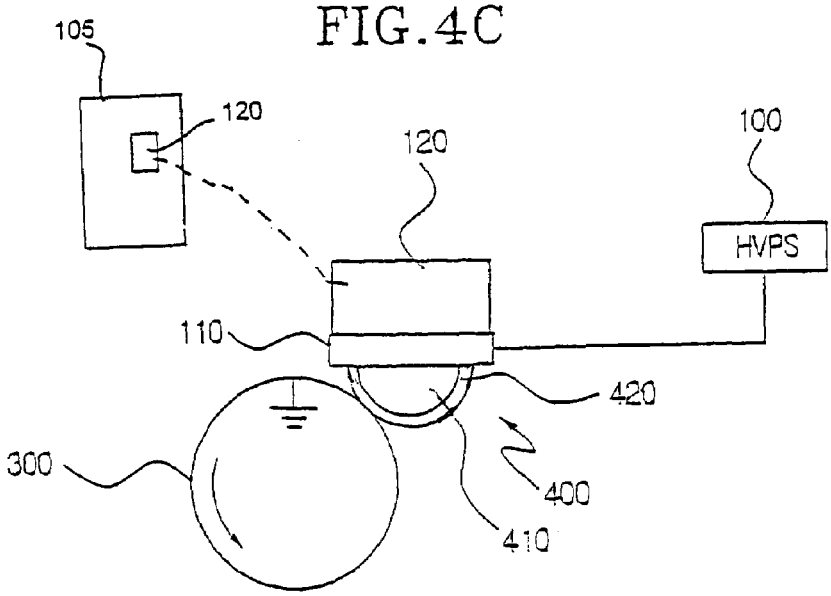
Figure 4D:
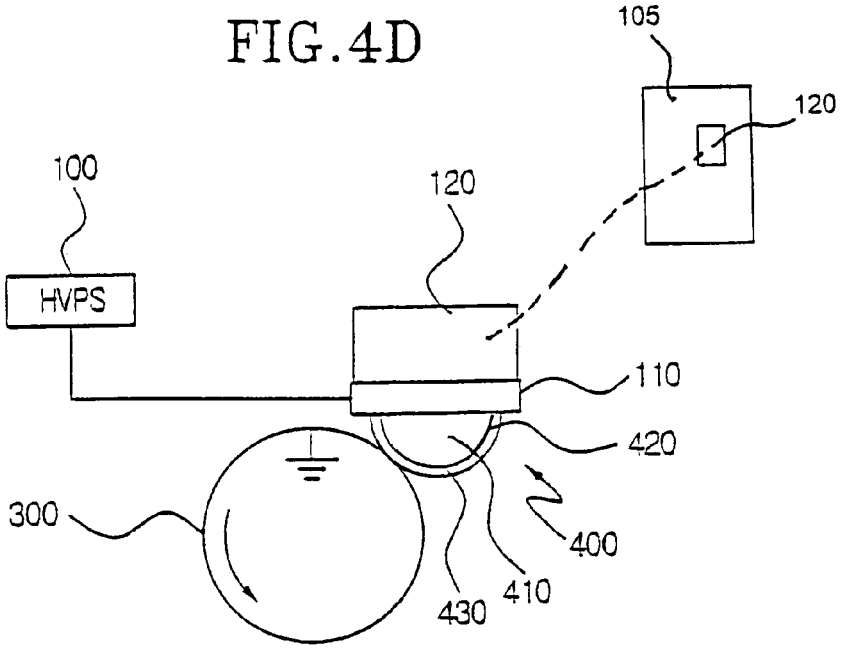
Figure 5:
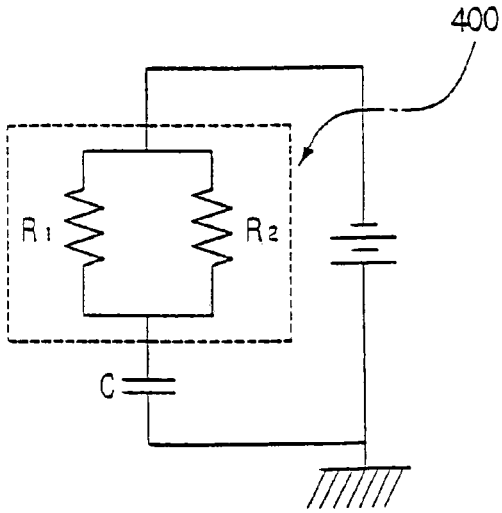
FIGS. 5 and 6 are circuit diagrams illustrating the charging device shown in FIGS. 4A through 4D.
Figure 6:
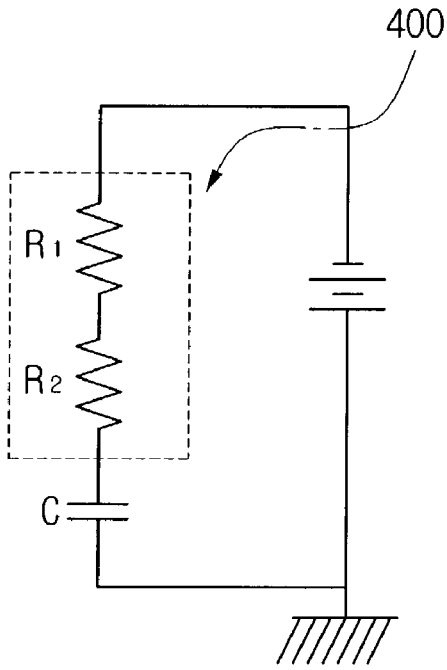
Figure 7:
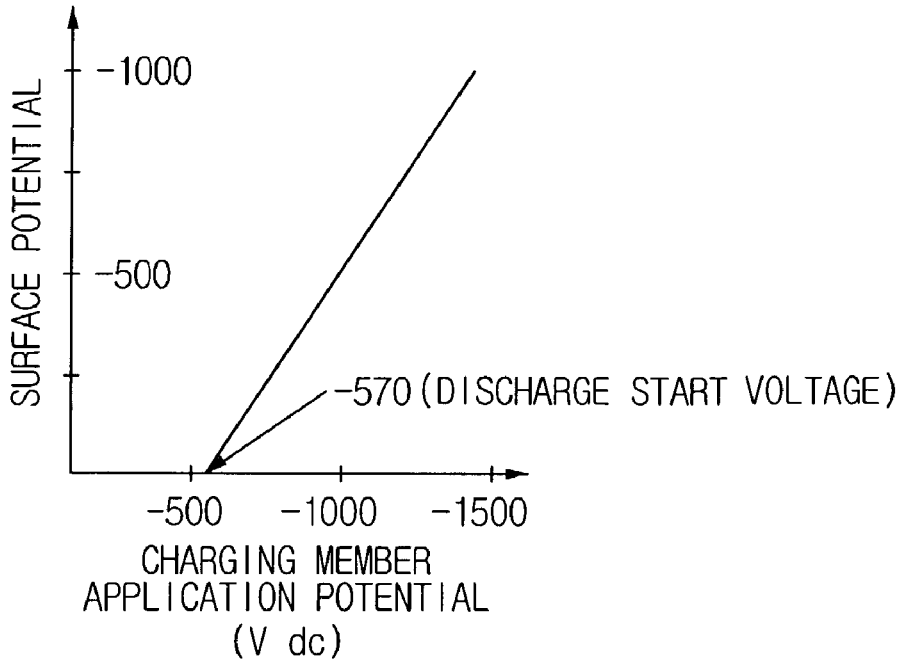
FIGS. 7 and 8 are graphs showing a surface potential of a photosensitive medium charged by the charging device shown in FIGS. 4A through 4D.

FIGS. 4A to 4D are schematic diagrams illustrating the charging device in accordance with embodiments of the present invention, FIGS. 5 and 6 are circuit diagrams illustrating the charging device of FIGS. 4A through 4D, and FIGS. 7 and 8 are graphs showing a surface potential of a photosensitive medium due to power from the charging device of FIGS. 4A through 4D.

Referring to FIGS. 4A to 4D, the charging device, charging a photosensitive medium of a developing device (unit) unit 105 includes a power supply device 100 supplying a high voltage, a terminal 110, a support member 120, and a charging member 400 having a layer (inner layer) 420 and/or an auxiliary member 430 (outer layer) to charge a photosensitive medium 300.

Figure 8:
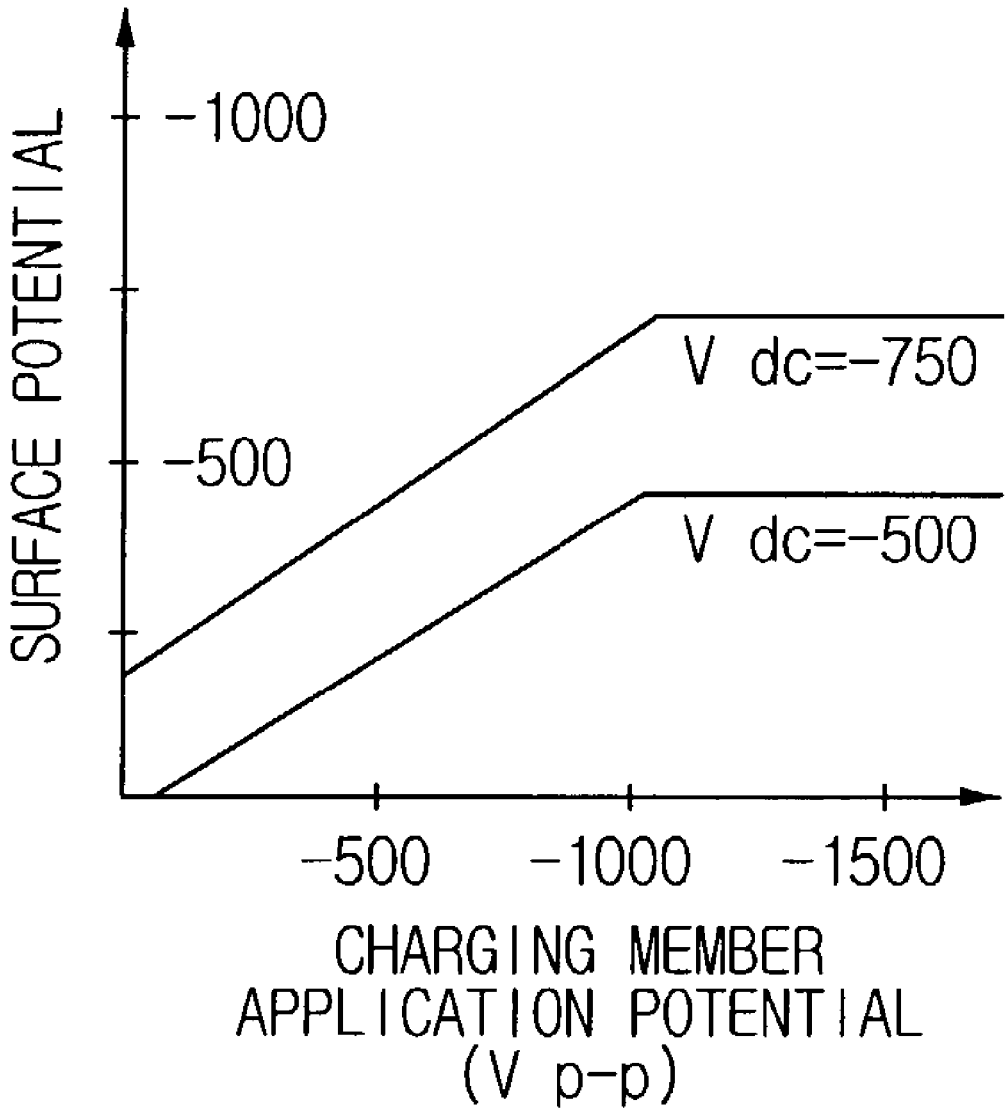

The power supply device 100 is a high voltage generating device supplying the high voltage to the charging member 400 through the terminal 110. As the supplied high voltage is a DC voltage, or a DC voltage overlapping with an AC voltage having a peak to peak voltage at least twice as high as a charging start voltage $V_{TH}$ of the DC voltage. When the DC voltage overlapping with the AC voltage is supplied to the photosensitive medium 300 through the terminal 110 and the charging member 400, a surface potential of the photosensitive medium 300 is easily stabilized as shown in FIG. 8. The charging member 400 charges the photosensitive medium 300. In the drawings, a drum type photosensitive medium is illustrated, but a belt type photosensitive medium is also employable as the photosensitive medium 300.

The support member 120 fixes and supports the terminal 100 and the charging member 400 on a developing unit of the image forming apparatus, and includes a single component or a plurality of components. In order to support the terminal 110 and the charging member 400 on the image forming apparatus, the support member 120 is mounted on the image forming apparatus using a fastening method using a screw, an adhesion method using an adhesive, a method using a guide groove, or a method using elasticity/plasticity transformation (deflection). The terminal 110 is an electrode uniformly transmitting the voltage from the high voltage power supply unit 100 to the charging member 400. The support member 120 formed of a conductive material and the high voltage terminal 110 may be incorporated into the single component.

An elastic auxiliary member 410 is formed to have a section equal to or greater than a section of the charging member 400 and installed in the inner layer 420 of the charging member 400. When receiving the DC voltage overlapping with the AC voltage, the elastic auxiliary member 410 attenuates a high frequency noise and supports a restoring force of the charging member 400.

The charging member 400 is formed of a conductive elastic material and is formed by using a singular or multilayer elastic member having both ends 401 fixed on two spaced portions of the terminal 110 or the support member 120 while a center portion 402 of the charging member 400 disposed between both ends forms a semi-elliptical or semicircular pipe-shaped section. The both ends are fixed to increase eccentricity of the semi-elliptical section of the center portion of the charging member 400 to obtain the semicircular charging member 400. When the terminal 110 serves as a support member supporting the charging member 400, both ends 401 of the charging member 400 are fixed to the terminal 110. An elastic coefficient, a thickness and a width of the charging member 400 are determined by Castigliano's theorem.

When a radius is R, and when a load W is transferred to the center portion 402 of the charging member 400, a relational expression of transformation (deflection) and load is obtained according to Castigliano's theorem.

Deflection δmay be represented by equation (1):

$$\text{deflection } \delta = W \times R^3/(E \times I) * ((3\pi/8)+(3/2\pi)-1) \quad (1)$$

Solving equation (1) for a load W gives the results of equation (2):

$$\text{and 'load } W = \delta EI/R^3 * 1/((3/8\pi)+(3/2\pi)-1)' \quad (2)$$

As equation (2) values are satisfied, a contact linear pressure is represented by equation (3):

$$F = W/L = \delta Et^3/(12R^3) * 1/((3\pi/8)+(3/2\pi)-1) \quad (3).$$

As used herein, 'E' represents an elastic coefficient of the conductive elastic member, 't' represents a thickness of the conductive elastic member, 'L' represents a width of the conductive elastic member. 'I' represents a second moment of area, as represented by equation (4)

$$I = 1/12 * L(\text{width}) * t^3(\text{thickness}) \quad (4).$$

The contact linear pressure varies by adjusting the deflection δ, the thickness t, and the radius R of the conductive elastic member of the charging member 400. Generally, the contact linear pressure ranges between 1 gf/cm and 80 gf/cm.

The contact linear pressure can be corrected by inserting the elastic auxiliary member 410 which is a foaming agent, such as a spongy, disposed in an inside of the semicircular pipe-type section of the charging member 400.

FIG. 5 is a circuit diagram illustrating an electric resistance by a single layer of the charging member 400. In FIG. 4A, a contact unit P is formed between the photosensitive medium 300 and the charging member 400. Resistances of the charging member 400 between the contact unit and both ends 401 are R1 and R2. 'C' denotes a capacitance of the photosensitive medium 300. The resistances R1 and R2 are represented by an expression of 'R1=ρ×L1/S' and 'R2=ρ×L2/S'. A total electrical resistance is a sum of reverse fractions of the two parallel resistances R1 and R2, which is represented by 'R=R1×R2/(R1+R2)'. Here, 'L(cm)' represents a length between the contact point and both ends, 'ρ' is a volume resistivity (Ωcm) of the charging member 400, and 'S' indicates a contact area of the charging member 400 and the photosensitive medium 300. Therefore, the total electric resistance varies by adjusting the volume resistivity ρ, the length L between the terminal 110 and the contact unit ρ, and the contact area S of the charging member 400 and the photosensitive medium 300.

The total electric resistance can be adjusted by using the volume resistivity of the conductive elastic member of the charging member 400, rarely influencing the contact linear pressure and the contact nip. It is possible that a contact resistance of the charging member 400 and the photosensitive medium 300 is '$1\times10^4\Omega$~$9\times10^8\Omega$', and the charging member 400 is formed of a conductive polymer, metal or conductive rubber having a volume resistivity of '$10^3\Omega$~$10^8\Omega$'. Advantageously, the charging member 400 has a thickness below 3 mm to maintain the appropriate deflection δ, and also has the radius below 10 mm.

The charging member 400 may include a plurality of layers. The layers of the charging member 400 include the inner layer 420 formed by using a material having a high conductivity, so that the resistance of the inner layer 420 rarely influences the total electrical resistance. That is, the total electrical resistance is determined by adjusting the resistance of the outer layer 430 of the charging member 400. The total resistance R is represented by 'R=ρ1×t1/S+ρ2×t2/S'. Here, 't' represents a thickness of the inner layer 420 and the outer layer 430. It is possible that the inner layer 420 has the volume resistivity below '$9\times10^7$ Ωcm', and the outer layer 430 has the volume resistivity over '$9\times10^6$ Ωcm'. In addition, the inner layer 420 is formed of a metal sheet or the conductive polymer, and the outer layer 430 is formed of a conductive rubber material or a conductive polymer.

Respective boards of the inner layer 420 and the outer layer 430 of the charging member 400 may be bonded by using an adhesive, or a variety of polymer materials may be coated on the board of the inner layer 420. The inner layer 420 and the outer layer 430 are bonded according to molding, pressing, etc.

In accordance with the present invention, the total resistance of the charging member 400 ranges between $10^4\Omega$ and $10^8\Omega$, the photosensitive medium 300 and the charging member 400 are contacted by maintaining the certain pressure and deflection by using the relational expression of the deflection and load according to the Castigliano's principle, and a predetermined current is transmitted to the photosensitive medium 300 by the voltage from the high voltage device 110 through the charging member 400, thereby improving uniformity of the surface potential of the photosensitive medium.

Moreover, when the foaming agent, such as sponge, is installed inside the charging member 400 as the elastic auxiliary member 430, the contact nip is stably maintained. In the case that the DC voltage overlaps with the AC voltage, noise due to a vibration of the photosensitive medium 300 is minimized during the discharge operation using AC frequency elements. The charging member 400 attenuates noise factors with a damping function by the elastic auxiliary member 430 and also serves as a sound adsorbing material.

In accordance with the present invention, the charging device provides the charging member with a predetermined curvature radius, for example, a semicircular or semi-elliptical shape, but the charging member does not have to maintain a certain curvature radius. In addition, the plate-shaped member has both ends fixed on the support member or terminal to form the pipe-shape section having the semicircular or semi-elliptical section, to stably maintain the contact nip while being in contact with the photosensitive medium. A variety of materials including rubber, polymer and metal are used rather than that used in a conventional charging roller by easily adjusting the property of the electrical resistance of the charging member. The conductive material restricting migration may also be used. Compared with the conventional contactable roller method, complicated processes, such as compression and polishing process, can be omitted in the process of the present invention to overcome charging defects occurring due to surface defects of the conventional contactable roller method. Moreover, processing expenses and production time can be remarkably reduced in mass production. Furthermore, since the structure of the charging device is simplified, the shaft of the conventional charging roller in the conventional contactable roller method is not necessary, and the boards are usable, which results in a low material cost.

Although the preferred embodiments of the present invention have been described, it is understood that the present invention should not be limited to these preferred embodiments but various changes and modifications can be made by one skilled in the art in these embodiments without departing from the principles and sprit of the invention, the scope of which is defined in the claims and their equivalents.

What is claimed is:

1. A charging device charging a photosensitive medium of a developing unit of an image formation apparatus, comprising:

a support member disposed in the developing unit;

a charging member having a center portion and two ends disposed at opposite sides of the center portion, spaced-apart from each other, and supported by the support member to form a curved section of the center portion between the two ends to contact and charge the photosensitive medium; and a terminal formed on the support member and having ends spaced-apart from each other to be connected to corresponding ones of the two ends of the charging member and to transmit a voltage to the charging member, wherein the charging member comprises:

a semicircular shaped cylinder or a semi-elliptical shaped cylinder.

2. The charging of claim 1, wherein the support member comprises two portions spaced apart from each other by a distance and coupled to corresponding ones of the two ends of the charging member, and the center portion of the charging member has a length greater than the distance.

3. The charging device of claim 1, wherein the support member comprises:

two portions spaced-apart from each other to support corresponding ones of the two ends of the charging member.

4. The charging device of claim 1, wherein the support member comprises a surface supporting the two ends of the charging member, and the center portion of the charging member is spaced apart from the surface of the support member.

5. The charging device of claim 1, wherein the charging member comprises a contact point formed on the center portion and disposed between the charging member and the photosensitive medium, and the charging member has a total resistance determined in accordance with a volume resistivity of the charging member, lengths between the contact point and the two ends, and a contact area of the charging member and the photosensitive medium.

6. The charging device of claim 5, wherein the total resistance of the charging member is expressed as a formula $RR=(R1+R2)/(R1*R2)$ where RR is the total resistance of the charging member, and R1 and R2 are first and second resistances between the contact and the two ends, respectively.

7. The charging device of claim 6, wherein the first and second resistances are expressed as a second formula $R1=\rho\times L1/S$ and $R2=\rho\times L2/S$, respectively, where L1 and L2 represent lengths between the contact point and both ends, respectively, ρ is the volume resistivity (Ω cm) of the charging member, and S is the contact area of the charging member and the photosensitive medium.

8. The charging device of claim 1, wherein the charging member forms a contact resistance with the photosensitive medium, and the contact resistance is in a range between $1\times10^4\Omega$ and $9\times10^8\Omega$ inclusive.

9. The charging device of claim 1, wherein a volume resistivity of the charging member is in a range between $10^3\Omega$ cm and $10^8\Omega$ cm.

10. The charging device of claim 1, wherein the support member comprises two portions spaced-apart from each other, and the charging member comprises:

an inner layer having two inner ends spaced-apart from each other and supported by the two portions of the support member so that an inner center portion of the inner layer disposed between the two inner ends is curved with respect to the support member.

11. The charging device of claim 10, wherein the charging member comprises:

an outer layer formed on an outer circumference surface of the inner layer, having an outer center portion curved corresponding to the inner center portion.

12. The charging device of claim 11, wherein the outer layer comprises:

two outer ends spaced-apart from each other and supported by the two portions of the support member so that the outer center portion is curved between the two outer ends.

13. The charging device of claim 11, wherein the inner layer has an inner volume resistivity different from an outer volume resistivity of the outer layer.

14. The charging device of claim 11, wherein the inner layer has an inner conductivity greater than an outer conductivity of the outer layer.

15. The charging device of claim 11, wherein the charging member has a total resistance expressed by a formula $RR=(\rho1\times t1)/S+(\rho2\times t2)/S$ where RR is the total resistance, t1 and t2 are a thickness of the inner layer and the outer layer, respectively, ρ1 and ρ2 are an inner volume resistivity of the inner layer and an outer volume resistivity of the outer layer, respectively, and S is a contact area formed between the charging member and the photosensitive medium.

16. The charging device of claim 11, wherein the inner layer has an inner volume resistivity below $9\times10^7\Omega$cm, and the outer layer has an outer volume resistivity over $9\times10^6\Omega$cm.

17. The charging device of claim 1, wherein the charging member has a deflection to apply a contact linear pressure to the photosensitive medium, and the contact linear pressure is expressed by a formula F=W/L where F is the contact linear pressure, W is a load transferred from the charging member to the photosensitive medium, and L is a width of the charging member.

18. The charging device of claim 17, wherein the contact linear pressure is expressed as a second formula $F=(\delta Et^3/(12R^3))*(1/((3\pi/8)+(3/2\pi)-1))$ where R is a radius of the center portion of the charging member, δ is the deflection, and t is a thickness of the charging member.

19. The charging device of claim 17, wherein the contact linear pressure is 9.15 gf/cm when a thickness of the charging member is 0.2 cm, a radius of the center portion of the charging member is 1 cm, the width of the charging member is 23 cm, an elastic coefficient of the charging member is 45 kg/cm$^2$, and the deflection of the charging member is 0.2 cm.

20. A method in a charging device charging a photosensitive medium of a developing unit of an image formation apparatus, comprising:

forming a support member having two portions spaced-apart from each other in the developing unit;

mounting on the two portions of the support member a charging member having two ends and a center portion disposed between the two ends; and connecting the two ends of the charging member to corresponding ones of the two portions of the support member so that the center portion of the charging member is spaced-apart from the support member and curved to contact the photosensitive medium, wherein the charging device comprises a terminal having two electrodes spaced apart from each other at respective ends of the terminal, and the connecting of the two ends of the charging member comprises connecting the two ends of the charging member to corresponding ones of the two electrodes of the terminal, and wherein the charging member comprises: a semicircular shaped cylinder or a semi-elliptical shaped cylinder.

* * * * *